US008117907B2

(12) United States Patent
Han et al.

(10) Patent No.: US 8,117,907 B2
(45) Date of Patent: Feb. 21, 2012

(54) CALIPER LOGGING USING CIRCUMFERENTIALLY SPACED AND/OR ANGLED TRANSDUCER ELEMENTS

(75) Inventors: Wei Han, Sugar Land, TX (US); Tsili Wang, Katy, TX (US)

(73) Assignee: PathFinder Energy Services, Inc., Houston, TX (US)

( * ) Notice: Subject to any disclaimer, the term of this patent is extended or adjusted under 35 U.S.C. 154(b) by 614 days.

(21) Appl. No.: 12/339,229

(22) Filed: Dec. 19, 2008

(65) Prior Publication Data

US 2010/0154531 A1 Jun. 24, 2010

(51) Int. Cl.
*E21B 47/00* (2006.01)

(52) U.S. Cl. ..... 73/152.58

(58) Field of Classification Search ..... 73/152.05, 73/152.47, 152.58; 702/6, 9
See application file for complete search history.

(56) References Cited

U.S. PATENT DOCUMENTS

| | | | | |
|---|---|---|---|---|
| 3,381,267 | A | | 7/1966 | Cubberly, Jr. et al. |
| 3,493,921 | A | | 2/1970 | Johns |
| 3,553,640 | A | | 1/1971 | Zemanek |
| 3,663,842 | A | | 5/1972 | Miller |
| 3,770,006 | A | | 11/1973 | Sexton et al. |
| 3,792,429 | A | | 2/1974 | Patton et al. |
| 3,867,714 | A | | 2/1975 | Patton |
| 4,382,201 | A | | 5/1983 | Trzaskos |
| 4,450,540 | A | | 5/1984 | Mallett |
| 4,485,321 | A | | 11/1984 | Klicker et al. |
| 4,523,122 | A | | 6/1985 | Tone et al. |
| 4,543,648 | A | | 9/1985 | Hsu |
| 4,571,693 | A | | 2/1986 | Birchak et al. |
| 4,594,691 | A | | 6/1986 | Kimball et al. |
| 4,601,024 | A | * | 7/1986 | Broding ..... 367/86 |
| 4,628,223 | A | | 12/1986 | Takeuchi et al. |
| 4,649,526 | A | | 3/1987 | Winbow et al. |
| 4,665,511 | A | | 5/1987 | Rodney et al. |
| 4,682,308 | A | | 7/1987 | Chung |
| 4,686,409 | A | | 8/1987 | Kaarmann et al. |
| 4,698,792 | A | | 10/1987 | Kurkjian et al. |
| 4,698,793 | A | | 10/1987 | Wu |
| 4,700,803 | A | | 10/1987 | Mallett et al. |

(Continued)

FOREIGN PATENT DOCUMENTS

CA 2346546 11/2001

(Continued)

OTHER PUBLICATIONS

International Search Report and Written Opinion dated Jul. 22, 2010 for PCT application No. PCT/US2009/067851.

(Continued)

*Primary Examiner* — John Fitzgerald

(57) ABSTRACT

A downhole tool includes circumferentially spaced and/or angled transducer elements. In one embodiment a standoff sensor has at least three piezoelectric transducer elements, at least a first element of which is configured to both transmit and receive ultrasonic energy. At least second and third of the elements are configured to receive ultrasonic energy transmitted by the first element in pitch catch mode. An electronic controller is configured to calculate a standoff distance from the ultrasonic waveforms received at the first, the second, and the third piezoelectric transducer elements. The controller may further be configured to estimate the eccentricity of a measurement tool in the borehole. Exemplary embodiments of the invention may improve borehole coverage and data quality and reliability in LWD caliper logging. In particular, the invention may advantageously reduce or even eliminate blind spots when logging eccentric bore holes.

14 Claims, 5 Drawing Sheets

U.S. PATENT DOCUMENTS 4,705,981 A 11/1987 Inoue et al.
4,774,693 A 9/1988 Winbow et al.
4,800,316 A 1/1989 Ju-Zhen
4,832,148 A 5/1989 Becker et al.
4,855,963 A 8/1989 Winbow et al.
4,872,526 A 10/1989 Wignall et al.
4,890,268 A 12/1989 Smith et al.
5,027,331 A 6/1991 Winbow et al.
5,036,945 A 8/1991 Hoyle et al.
5,038,067 A 8/1991 Tabin
5,038,069 A 8/1991 Lukasiewicz et al.
5,077,697 A 12/1991 Chang
5,109,698 A 5/1992 Owen
5,130,950 A 7/1992 Orban et al.
5,191,796 A 3/1993 Kishi et al.
5,229,553 A 7/1993 Lester et al.
5,265,067 A 11/1993 Chang
5,278,805 A 1/1994 Kimball
5,331,604 A 7/1994 Chang et al.
5,354,956 A 10/1994 Orban et al.
5,387,767 A 2/1995 Aron et al.
RE34,975 E 6/1995 Orban et al.
5,469,736 A 11/1995 Moake
5,486,695 A 1/1996 Schultz et al.
5,510,582 A 4/1996 Birchak et al.
5,544,127 A 8/1996 Winkler
5,644,186 A 7/1997 Birchak et al.
5,661,696 A 8/1997 Kimball et al.
5,678,643 A 10/1997 Robbins et al.
5,711,058 A 1/1998 Frey
5,726,951 A 3/1998 Birchak et al.
5,753,812 A 5/1998 Aron et al.
5,784,333 A 7/1998 Tang et al.
5,808,963 A 9/1998 Esmersoy
5,831,934 A 11/1998 Gill et al.
5,844,349 A 12/1998 Oakley et al.
5,852,587 A 12/1998 Kostek et al.
5,899,958 A 5/1999 Dowell et al.
5,936,913 A 8/1999 Gill et al.
5,960,371 A 9/1999 Saito et al.
6,014,898 A 1/2000 Finsterwald et al.
6,067,275 A 5/2000 Sayers
6,082,484 A 7/2000 Molz et al.
6,088,294 A 7/2000 Leggett, III et al.
6,102,152 A 8/2000 Masino et al.
6,107,722 A 8/2000 Thurn
6,147,932 A 11/2000 Drumheller
6,188,647 B1 2/2001 Drumheller
6,208,585 B1 3/2001 Stroud
6,213,250 B1 4/2001 Wisniewski et al.
6,236,144 B1 5/2001 Millar et al.
6,258,034 B1 7/2001 Hanafy
6,272,916 B1 8/2001 Taniguchi et al.
6,308,137 B1 10/2001 Underhill et al.
6,310,426 B1 10/2001 Birchak et al.
6,320,820 B1 11/2001 Gardner et al.
6,354,146 B1 3/2002 Birchak et al.
6,396,199 B1 5/2002 Douglas et al.
6,405,136 B1 6/2002 Li et al.
6,459,993 B1 10/2002 Valero et al.
6,467,140 B2 10/2002 Gururaja
6,477,112 B1 11/2002 Tang et al.
6,480,118 B1 11/2002 Rao
6,535,458 B2 3/2003 Meehan
6,543,281 B2 4/2003 Pelletier et al.
6,568,486 B1 5/2003 George
6,584,837 B2 * 7/2003 Kurkoski ..... 73/152.02
6,607,491 B2 8/2003 Sato
6,614,716 B2 9/2003 Plona et al.
6,615,949 B1 9/2003 Egerev et al.
6,618,322 B1 9/2003 Georgi
6,625,541 B1 9/2003 Shenoy et al.
6,631,327 B2 10/2003 Hsu et al.
6,654,688 B1 11/2003 Brie et al.
6,671,380 B2 12/2003 Chang et al.
6,776,762 B2 8/2004 Erikson et al.
6,788,620 B2 9/2004 Shiraishi et al.
6,829,947 B2 12/2004 Han et al.
6,894,425 B1 5/2005 Solomon et al.
6,897,601 B2 5/2005 Birth et al.
6,938,458 B2 9/2005 Han et al.
7,036,363 B2 5/2006 Yogeswaren
7,464,588 B2 * 12/2008 Steinsiek ..... 73/152.55
7,966,874 B2 * 6/2011 Hassan et al. ..... 73/152.03
2002/0062992 A1 5/2002 Fredericks et al.
2002/0096363 A1 7/2002 Evans et al.
2002/0113717 A1 8/2002 Tang et al.
2003/0002388 A1 1/2003 Mandal
2003/0018433 A1 1/2003 Blanch et al.
2003/0058739 A1 3/2003 Hsu et al.
2003/0106739 A1 6/2003 Arian et al.
2003/0114987 A1 6/2003 Edwards et al.
2003/0123326 A1 7/2003 Wisniewski et al.
2003/0137302 A1 7/2003 Clark et al.
2003/0137429 A1 7/2003 Clark et al.
2003/0139884 A1 7/2003 Blanch et al.
2003/0141872 A1 7/2003 Clark et al.
2003/0150262 A1 8/2003 Han et al.
2003/0167126 A1 9/2003 Horne et al.
2004/0095847 A1 * 5/2004 Hassan et al. ..... 367/25
2005/0006620 A1 1/2005 Helke
2005/0259512 A1 11/2005 Mandal
2005/0283315 A1 12/2005 Haugland
2008/0186805 A1 8/2008 Han

FOREIGN PATENT DOCUMENTS

EP 0375549 A2 6/1990
EP 1158138 A2 11/2001
GB 2156984 A 10/1985
GB 2381847 A 5/2003
WO WO0072000 A1 11/2000

OTHER PUBLICATIONS

Boonen, P. and Yogeswaren, E., "A Dual Frequency LWD Sonic Tool Expands Exhibiting Unipolar Transmitter Technology to Supply Shear Wave Data in Soft Formations," SPWLA 45th Annual Logging Symposium, Jun. 6-9, 2004, Noordwijk, Netherlands, Paper X.

Cheng, C. H. and Toksoz, M. N., "Determination of Shear Wave Velocities in "Slow" Formations," SPWLA 24th Annual Logging Symposium, Jun. 37-30, 1983, Paper V.

Cheng, C. H. and Toksoz, M. N., "Elastic Wave Propagation in a Fluid-Filled Borehole and Synthetic Acoustic Logs," Geophysics, vol. 46, No. 7, Jul. 1981, pp. 1042-1053.

El-Wazeer, F. et al., "Applications for a Full Wave Sonic LWD Tool in the Middle East," Society of Petroleum Engineers 13th Middle East Oil Show & Conference, Apr. 5-8, 2003, SPE 81474.

Gardner, G. H. F., et al., "Formation Velocity and Density—The Diagnostic Basics for Stratigraphic Traps," Geographics, vol. 39, No. 6, Dec. 1974, pp. 770-780.

Haugland, S. M., "Analytical Solution for an Eccentric Mandrel in a Fluid-filled Borehole: The Acoustic Case," SEG International Exhibition and 74th Annual Meeting, Denver, CO, Oct. 10-15, 2004.

Haugland, S. M., "Frequency Dispersion Effects on LWD Shear Sonic Measurements in Acoustically Sloe Environments," SPE Paper 90505, SPE Annual Technical Conference and Exhibition, Houston, Texas, Sep. 26-29, 2004.

Haugland, S. M., "Mandrel Eccentricity Effects on Acoustic Borehole-Guided Waves," SEG International Exhibition and 74th Annual Meeting, Denver, CO, Oct. 10-15, 2004.

Haung, X., "Effects of Tool Positions on Borehole Acoustic Measurements: A Stretched Grid Finite Difference Approach," Dissertation, MIT, Apr. 2003.

Hsu, C. and Sinha,K.K., "Mandrel effects on the dipole flexural mode in a borehole," J. Acoust. Soc. Am. 104(4), Oct. 1998, pp. 2025-2039.

Market, J., et al., "Processing and Quality Control of LWD Dipole Sonic Measurements," SPWLA 43rd Annual Logging Symposium, Jun. 2-5, 2002, Paper PP.

McKeighen, R.E., "Design Guidelines for Medical Ultrasonic Arrays", SPIE International Symposium on Medical Imaging, Feb. 25, 1998.

Ohm, R.F., "The Vanderbilt Rubber Handbook, 13th Ed.", R.T. Vanderbilt Company, Inc., Nowalk, CT, 1990, pp. 211-222.

Schmitt, D. P., "Shear Wave Logging in Elastic Formations," J. Acoust. Soc. A., 84(6), Dec. 1988, pp. 2215-2229.

Smith, W.A., "New Opportunities in Ultrasonic Transducers Emerging from Innovations in Piezoelectric Materials", SPIE vol. 1733, 1992, pp. 3-26.

Taner, M.T., Koehler, F., and Sheriff, R. E., "Complex seismic trace analysis," Geophysics, vol. 44, No. 6 (Jun. 199); pp. 1041-1063.

Tang, X.M., et al., "Shear-Velocity Measurements in the Logging-While Drilling Environment: Modeling and Field Evaluations," Petrophysics, vol. 44, No. 2 (Mar.-Apr. 2003), pp. 79-90.

Varsamis, G. L. et al, "LWD Shear Velocity Logging in Slow Formations Design Decisions and Case Histories," SPWLA 41st Annual Logging Symposium, Jun. 4-7, 2000, Paper O.

Varsamis, G.L., et al., "A New MWD Full Wave Dual Mode Sonic Tool Design and Case Histories," SPWLA 40th Annual Logging Symposium, May 30-Jun. 3, 1999, Paper P.

Winbow, G.A., "A theoretical study of acoustic-S-wave and P-wave velocity logging with conventional and dipole sources in soft formations," *Geophysics*, vol. 53, No. 10, Oct. 1988, pp. 1334-1342.

Product Literature "Dyneon Fluoroelastomer FC2178", obtained from Dyneon, Decator, Alabama, Jun. 2003.

Product Literature "Dyneon Fluoroelastomer FC2181", obtained from Dyneon, Decator, Alabama, Jun. 2003.

Product Literature "Dyneon Fluoroelastomer FE5623", obtained from Dyneon, Decator, Alabama, Jun. 2003.

Product Literature Obtained from Corning Glass Works Corporation, Houghton Park, New York, Jun. 2003.

Product Literature Obtained from Ohara Corporation, 23141 Arroyo Vista, Santa Margarita, CA, Jul. 2003. http://www.oharacorp.com/swf/ap.html.

Technical Information "Viton®B-50", DuPont Dow elastomers, dated Dec. 1998, Wilmington, Delware 19809.

* cited by examiner

CALIPER LOGGING USING CIRCUMFERENTIALLY SPACED AND/OR ANGLED TRANSDUCER ELEMENTS

FIELD OF THE INVENTION

The present invention relates generally to a downhole tool for making standoff and caliper measurements. More particularly, exemplary embodiments of the invention relate to a downhole tool having at least one angled ultrasonic transducer. Another exemplary embodiment of the invention relates to a standoff sensor including at least first, second, and third transducer elements.

BACKGROUND OF THE INVENTION

Logging while drilling (LWD) techniques are well-known in the downhole drilling industry and are commonly used to measure various formation properties during drilling. Such LWD techniques include, for example, natural gamma ray, spectral density, neutron density, inductive and galvanic resistivity, acoustic velocity, and the like. Many such LWD techniques require that the standoff distance between the various logging sensors in the drill string and the borehole wall be known with a reasonable degree of accuracy. For example, LWD nuclear/neutron measurements utilize the standoff distance in the count rate weighting to correct formation density and porosity data. Moreover, the shape of the borehole (in addition to the standoff distances) is known to influence logging measurements.

Ultrasonic standoff measurements and/or ultrasonic caliper logging measurements are commonly utilized during drilling to determine standoff distance and therefore constitute an important downhole measurement. Ultrasonic caliper logging measurements are also commonly used to measure borehole size, shape, and the position of the drill string within the borehole. Conventionally, ultrasonic standoff and/or caliper measurements typically include transmitting an ultrasonic pulse into the drilling fluid and receiving the portion of the ultrasonic energy that is reflected back to the receiver from the drilling fluid borehole wall interface. The standoff distance is then typically determined from the ultrasonic velocity of the drilling fluid and the time delay between transmission and reception of the ultrasonic energy.

Caliper logging measurements are typically made with a plurality of ultrasonic sensors (typically two or three). Various sensor arrangements are known in the art. For example, caliper LWD tools employing three sensors spaced equi-angularly about a circumference of the drill collar are commonly utilized. Caliper LWD tools employing only two sensors are also known. For example, in one two-sensor caliper logging tool, the sensors are deployed on opposite sides of the drill collar (i.e., they are diametrically opposed). In another two-sensor caliper logging tool, the sensors are axially spaced, but deployed at the same tool face.

The above described prior art caliper LWD tools commonly employ either pulse echo ultrasonic sensors or pitch-catch ultrasonic sensors. A pulse echo ultrasonic sensor emits (transmits) ultrasonic waves and receives the reflected signal using the same transducer element. Pulse echo sensors are typically less complex and therefore less expensive to utilize. Pitch catch sensors typically include two transducer elements; the first of which is used as a transmitter (i.e., to transmit ultrasonic waves) and the other of which is utilized as a receiver (i.e., to receive the reflected ultrasonic signal). Pitch catch ultrasonic sensors are known to advantageously reduce, or even eliminate, transducer ringing effects, by substantially electromechanically isolating the transmitter and receiver transducer elements. They therefore tend to exhibit an improved signal to noise ratio (as compared to pulse echo sensors).

The above described caliper logging tools generally work well (providing both accurate and reliable standoff determination) when the drill string is centered (or nearly centered) in a circular borehole. In such instances the transmitted wave is essentially normal to the borehole wall, which tends to maximize the reflection efficiency at the receiver. In many drilling operations (e.g., in horizontal or highly inclined wells) the drill string can be eccentered in the borehole. Moreover, in certain formation types the borehole may have an irregular (e.g., elliptical or oval) shape. In these operations the transmitted ultrasonic waves are sometimes incident on the borehole wall at a non-normal (oblique) angle, which can result in reduced ultrasonic energy at the receiver. In some cases there may be blind spots at which the reflected waves are undetected by the sensor. In such cases, a portion of the borehole wall is invisible to the standoff sensor. Since standoff measurements are essential to interpreting certain other LWD data, these blind spots can have significant negative consequences (e.g., especially in pay zone steering operations).

Therefore, there exists a need for an improved caliper LWD tool and/or a caliper tool utilizing improved standoff sensors, particularly for use in deviated (e.g., horizontal) well bores in which the drill string is commonly eccentered (e.g., on bottom). Such a tool and/or sensors may advantageously improve the reliability of caliper LWD measurements.

SUMMARY OF THE INVENTION

The present invention addresses one or more of the above-described drawbacks of prior art standoff measurement techniques and prior art drilling fluid ultrasonic velocity estimation techniques. One aspect of this invention includes a downhole measurement tool having at least one angled ultrasonic standoff sensors. Another aspect of the present invention includes a downhole standoff sensor having at least three circumferentially spaced piezoelectric transducer elements. At least a first element is configured for use in pulse echo mode and therefore both transmits and receives ultrasonic energy. At least second and third elements are configured to receive ultrasonic energy transmitted by the first element in pitch catch mode. An electronic controller is configured to determine a standoff distance from the ultrasonic waveforms received at the at least first, second, and third piezoelectric transducer elements. The controller may further be configured to estimate the eccentricity of a measurement tool in the borehole, for example, from a difference or ratio between the ultrasonic energy received at the second and third transducer elements.

Exemplary embodiments of the present invention advantageously provide several technical advantages. For example, exemplary embodiments of the invention may improve borehole coverage and data quality and reliability in LWD caliper logging. In particular, the invention may advantageously reduce or even eliminate the blind spots when logging eccentric bore holes. Since standoff measurements are critical to certain LWD data interpretation, the invention may further improve the quality and reliability of such LWD data.

In one aspect the present invention includes a downhole logging while drilling tool. The logging while drilling tool includes a substantially cylindrical tool body having a longitudinal axis and is configured to be connected with a drill string. At least one standoff sensor is deployed in the tool body. The standoff sensor is configured to both transmit ultrasonic energy into a borehole and receive reflected ultrasonic energy. The standoff sensor has a sensor axis which defines a direction of optimum signal transmission and reception. The sensor axis is orthogonal to the longitudinal axis of the tool body and is further oriented at a non-zero angle relative to a radial direction in the tool body. The logging while drilling tool further includes a controller including instructions for determining a standoff distance from the reflected ultrasonic energy received at the at least one standoff sensor.

In another aspect, this invention includes a downhole logging while drilling tool. The logging while drilling tool includes a substantially cylindrical tool body having a longitudinal axis and is configured to be connected with a drill string. The tool further includes at least first, second, and third circumferentially spaced piezoelectric transducer elements. At least a first of the transducer elements is configured to both transmit ultrasonic energy into a borehole and receive reflected ultrasonic energy. At least a second and a third of the transducer elements are configured to receive the reflected ultrasonic energy transmitted by the first transducer element. The logging while drilling tool further includes a controller having instructions for determining a single standoff distance from the reflected ultrasonic energy received at the first, second, and third transducer elements.

In still another aspect, this invention includes a method for estimating downhole an eccentricity of a logging drilling tool. The method includes deploying a downhole tool in a subterranean borehole, the tool including an ultrasonic standoff sensor having at least three circumferentially spaced piezoelectric transducer elements, at least a first of the transducer elements being configured to both transmit ultrasonic energy into a borehole and receive reflected ultrasonic energy, at least a second and a third of the transducer elements being configured to receive the reflected ultrasonic energy originally transmitted by the first transducer element. The method further includes causing the first transducer element to transmit ultrasonic energy into the borehole, causing at least the second and the third transducer elements to receive the ultrasonic energy transmitted by the first transducer element, and processing the received ultrasonic energy to estimate a degree of eccentricity of the downhole tool in the borehole.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
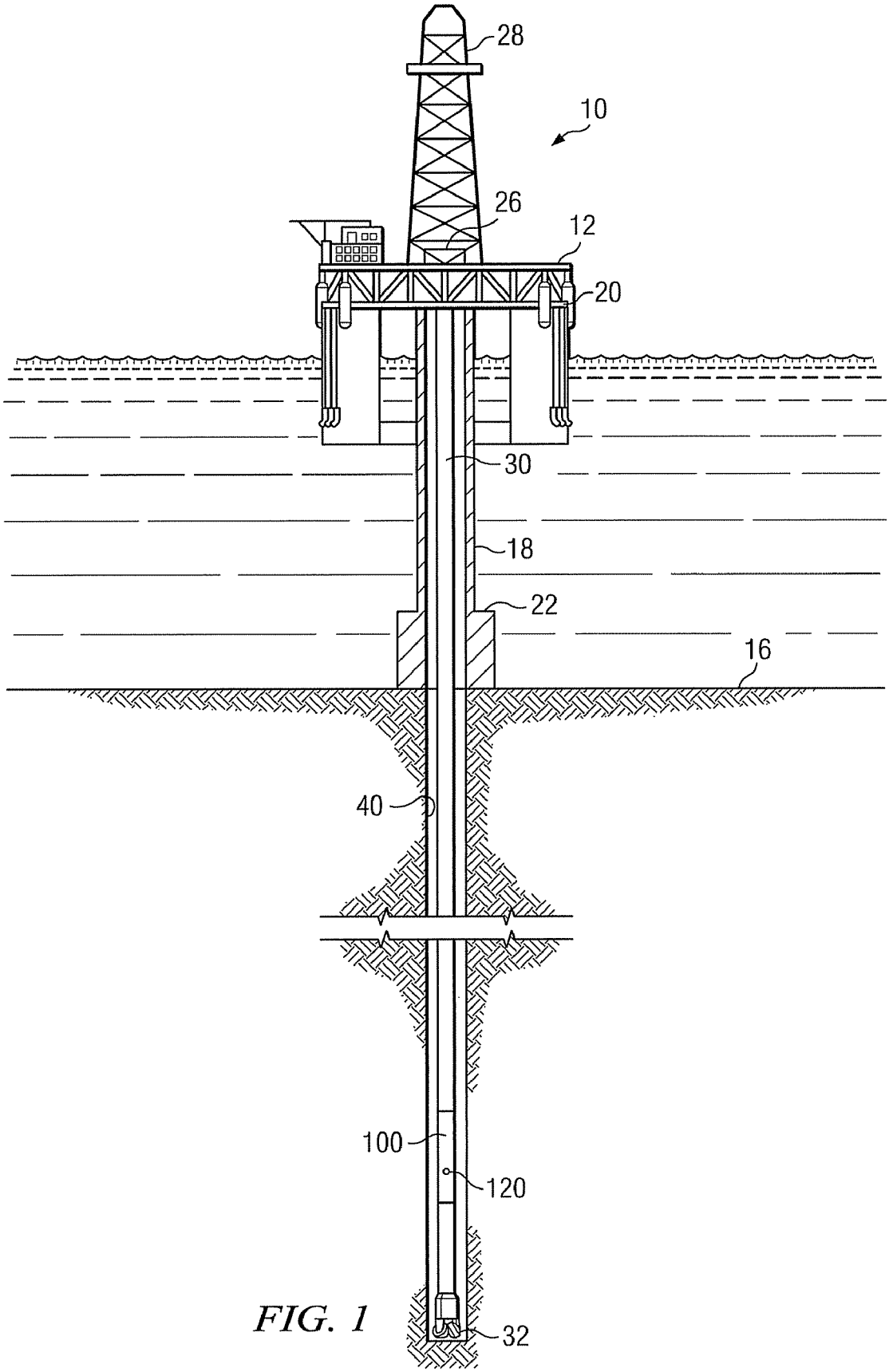
FIG. 1 is a schematic representation of an offshore oil and/or gas drilling platform utilizing an exemplary embodiment of the present invention.

Referring first to FIGS. 1 through 6, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 6 may be described herein with respect to that reference numeral shown on other views. It will all be appreciated that FIGS. 1-6 are schematic in nature and are therefore not drawn to scale.

FIG. 1 depicts one exemplary embodiment of a logging while drilling tool 100 in accordance with the present invention in use in an offshore oil or gas drilling assembly, generally denoted 10. In FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a logging while drilling tool 100 having an ultrasonic standoff sensor 120. Drill string 30 may further include substantially any other downhole tools, including for example, a downhole drill motor, a mud pulse telemetry system, and one or more other sensors, such as a nuclear or sonic logging sensor, for sensing downhole characteristics of the borehole and the surrounding formation.

It will be understood by those of ordinary skill in the art that the measurement tool 100 of the present invention is not limited to use with a semisubmersible platform 12 as illustrated in FIG. 1. LWD tool 100 is equally well suited for use with any kind of subterranean drilling operation, either offshore or onshore.

Figure 2:
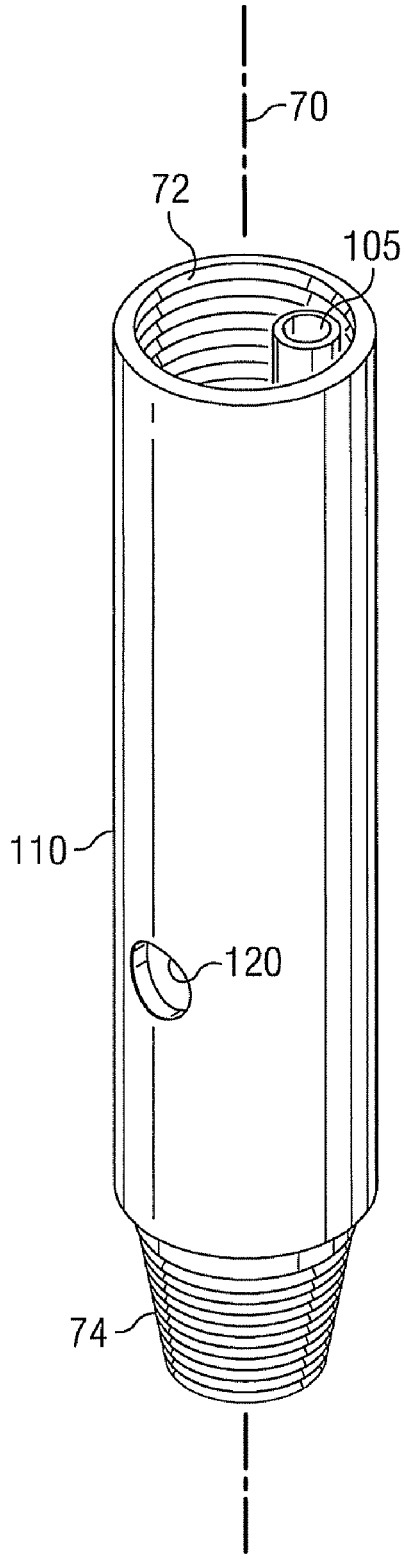
FIG. 2 depicts one exemplary embodiment of the downhole tool shown on FIG. 1.

Referring now to FIG. 2, one exemplary embodiment of LWD tool 100 according to the present invention is shown deployed in a subterranean borehole. LWD tool 100 includes at least one standoff sensor 120 deployed in the tool body (drill collar) 110. In the exemplary embodiment shown, LWD tool 100 is configured as a measurement sub, including a substantially cylindrical tool collar 110 configured for coupling with a drill string (e.g., drill string 30 in FIG. 1) and therefore typically, but not necessarily, includes threaded pin 74 and box 72 end portions. Through pipe 105 provides a conduit for the flow of drilling fluid downhole, for example, to a drill bit assembly (e.g., drill bit 32 in FIG. 1). As is known to those of ordinary skill in the art, drilling fluid is typically pumped down through pipe 105 during drilling. It will be appreciated that LWD tool 100 may include other LWD sensors (not shown), for example, including one or more nuclear (gamma ray) density sensors. Such sensors when utilized may be advantageously circumferentially aligned with standoff sensor 120. The invention is not limited in these regards.

With continued reference to FIG. 2, it will be appreciated that standoff sensor 120 may include substantially any known ultrasonic standoff sensors suitable for use in downhole tools. For example, sensor 120 may include conventional piezoceramic and/or piezo-composite transducer elements. Suitable piezo-composite transducers are disclosed, for example, in commonly assigned U.S. Pat. No. 7,036,363. Sensor 120 may also be configured to operate in pulse-echo mode, in which a single element is used as both the transmitter and receiver, or in a pitch-catch mode in which one element is used as a transmitter and a separate element is used as the receiver. Typically, a pulse-echo transducer may generate ring-down noise (the transducer once excited reverberates for a duration of time before an echo can be received and analyzed), which, unless properly damped or delayed, can overlap and interfere with the received waveform. Pitch-catch transducers tend to eliminate ring-down noise, and are generally preferred, provided that the cross-talk noise between the transmitter and receiver is sufficiently isolated and damped.

Although not shown on FIG. 2, it will be appreciated that LWD tools in accordance with this invention typically include an electronic controller. Such a controller typically includes conventional electrical drive voltage electronics (e.g., a high voltage power supply) for applying waveforms to the standoff sensor 120. The controller typically also includes receiving electronics, such as a variable gain amplifier for amplifying the relatively weak return signal (as compared to the transmitted signal). The receiving electronics may also include various filters (e.g., pass band filters), rectifiers, multiplexers, and other circuit components for processing the return signal.

A suitable controller typically further includes a digital programmable processor such as a microprocessor or a microcontroller and processor-readable or computer-readable programming code embodying logic, including instructions for controlling the function of the tool. Substantially any suitable digital processor (or processors) may be utilized, for example, including an ADSP-2191M microprocessor, available from Analog Devices, Inc. The controller may be disposed, for example, to calculate a standoff distance between the sensor and a borehole wall based on the ultrasonic sensor measurements. A suitable controller may therefore include instructions for determining arrival times and amplitudes of various received waveform components and for solving various algorithms known to those of ordinary skill in the art.

A suitable controller may also optionally include other controllable components, such as sensors, data storage devices, power supplies, timers, and the like. The controller may also be disposed to be in electronic communication with various sensors and/or probes for monitoring physical parameters of the borehole, such as a gamma ray sensor, a depth detection sensor, or an accelerometer, gyro or magnetometer to detect azimuth and inclination. The controller may also optionally communicate with other instruments in the drill string, such as telemetry systems that communicate with the surface. The controller may further optionally include volatile or non-volatile memory or a data storage device. The artisan of ordinary skill will readily recognize that the controller may be disposed elsewhere in the drill string (e.g., in another LWD tool or sub).

Figure 3:
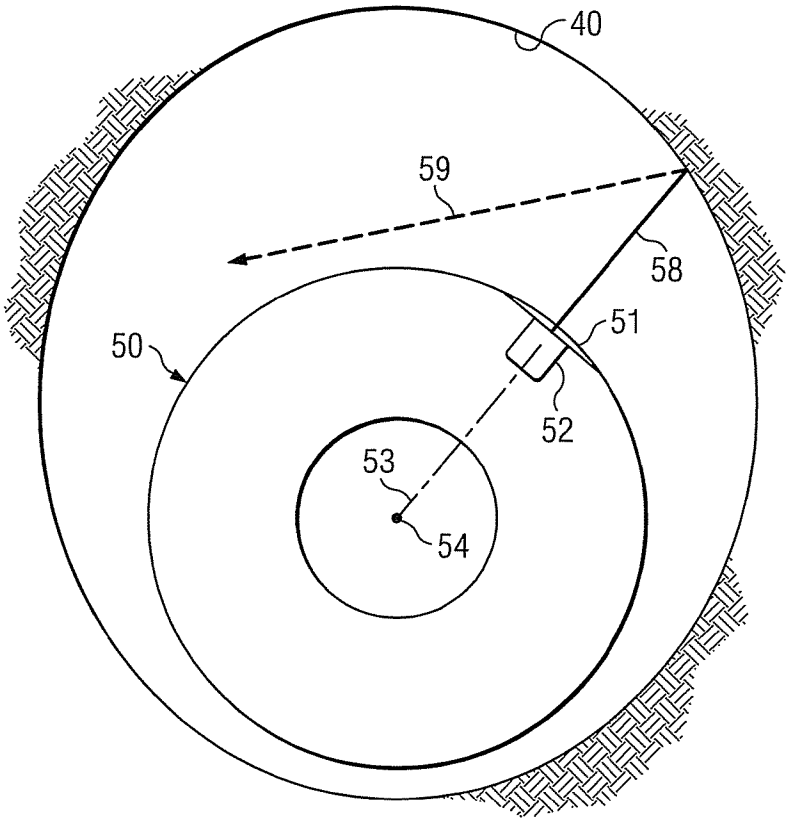
FIG. 3 (PRIOR ART)
FIG. 3 depicts, in circular cross section, a prior art arrangement deployed in a borehole.

FIG. 3, depicts in circular cross section, a prior art standoff measurement tool 50 deployed in a borehole. Prior art measurement tool 50 includes at least one standoff sensor 52 deployed on the tool body 51. Those of ordinary skill in the art will readily recognize that embodiments including two or more standoff sensors deployed about the circumference of a downhole tool are also well known. Standoff sensor 52 is mounted conventionally in that the sensor axis 53 (the axis of maximum transmission and reception efficiency) lies in the circular plane and passes through the geometric center 54 of the tool. Stated another way, the sensor axis 53 of a conventionally mounted standoff sensor 52 is aligned with a radius of the tool 50. Such mounting is referred to herein as "normally mounted."

As also shown on FIG. 3, a conventionally mounted sensor 52 may not always be disposed to receive an obliquely reflected wave in a decentralized drill string. As shown (when the tool is decentralized) the transmitted ultrasonic waves 58 can be incident on the borehole wall 40 at a non-normal (oblique) angle, which can result in reduced energy at the receiver. In some cases there may be blind spots at which the reflected waves 59 go essentially undetected by the sensor. In such cases, a portion of the borehole wall is essentially invisible to the standoff sensor 52. Since standoff measurements are essential to interpreting some other types of LWD data (as described above), these blind spots can have significant negative consequences (e.g., especially in pay zone steering operations).

Figure 4:
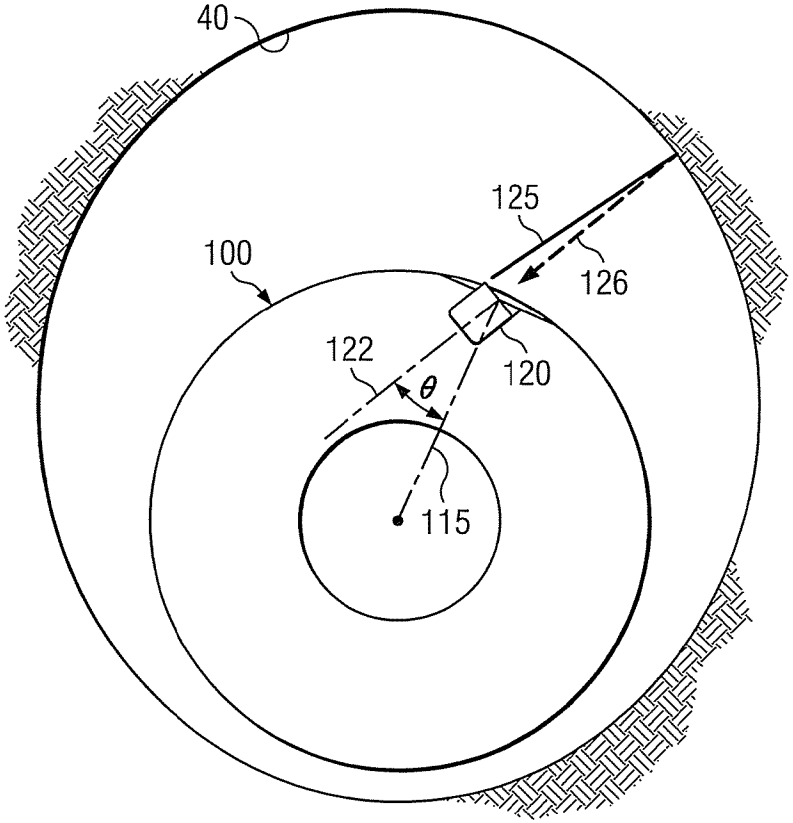
FIG. 4 depicts, in circular cross section, one exemplary embodiment of the present invention deployed in borehole.

With reference now to FIG. 4, LWD tool 100 in accordance with the present invention is shown (in circular cross section) deployed in a borehole. LWD tool 100 includes at least one angled standoff sensor 120 deployed in tool body 110. Standoff sensor 120 is configured for use in pulse echo mode and is angled such that the sensor axis 122 is oriented at a non-zero angle θ with respect to the tool radius 115. For example, in certain exemplary embodiments, the angle θ may be in a range from about 5 to about 30 degrees. An angled standoff sensor 120 transmits an ultrasonic wave 125 at an angle such that the wave is reflected 126 approximately normally from the borehole wall 40 and is therefore received back at the sensor 120 (as shown in the exemplary embodiment on FIG. 4). It will be appreciated that LWD tool 100 may include multiple angled sensors. For example, in one exemplary embodiment, a standoff measurement tool in accordance with the invention includes three standoff sensors, at least two of which are angled, configured to minimize (or substantially eliminate) blind spots when the tool is eccentered in a borehole having a highly elliptical profile.

Figure 5B:
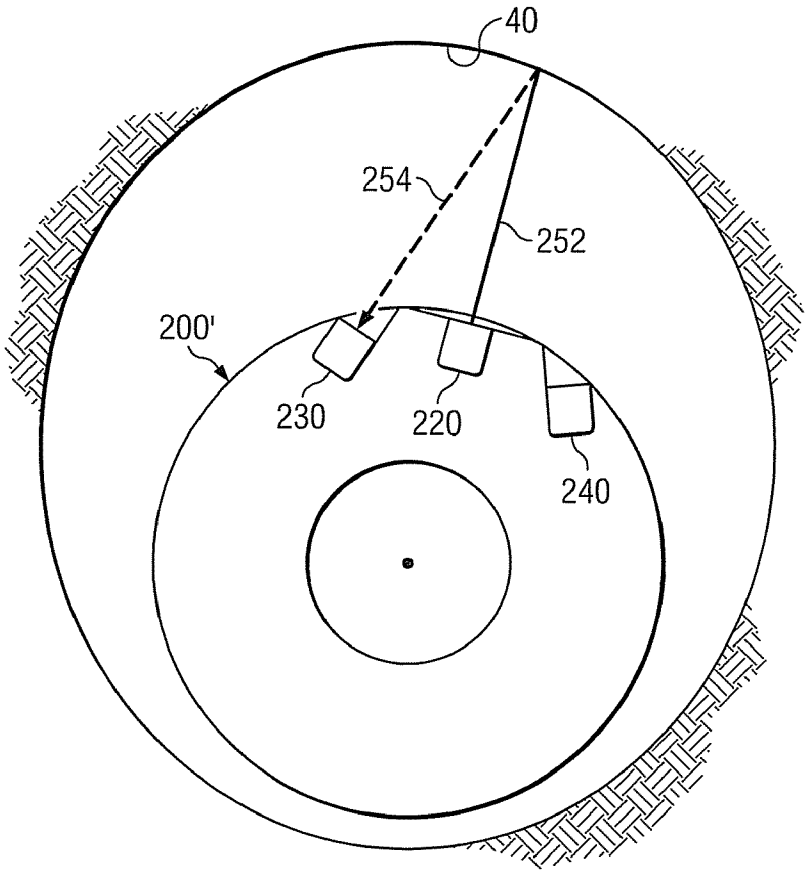
FIGS. 5A and 5B depict, in circular cross section, other exemplary embodiments of the invention.
Figure 5A:
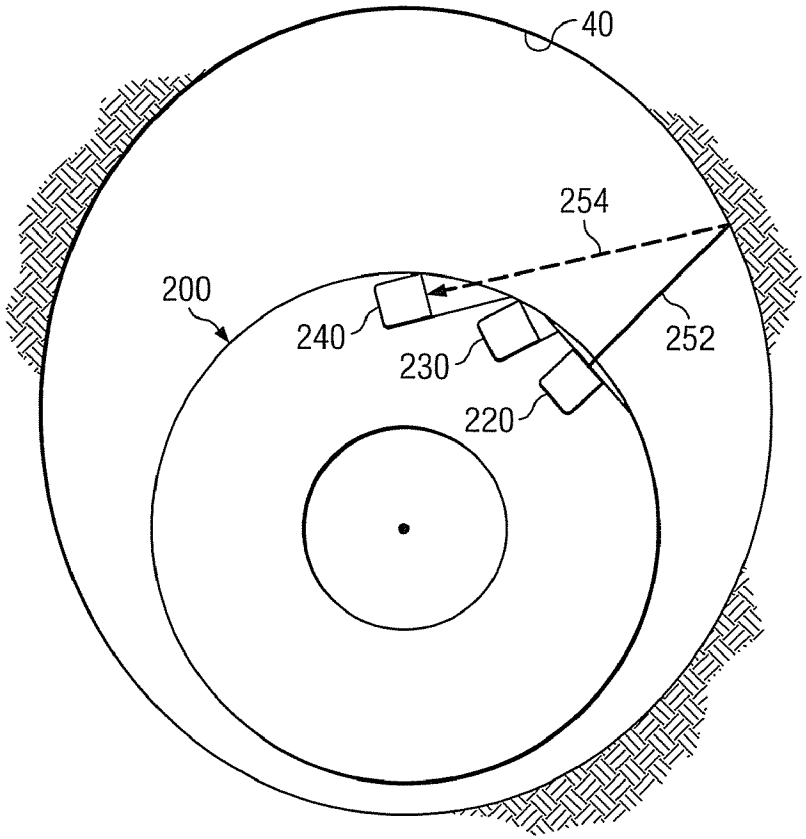

With reference now to FIGS. 5A and 5B, standoff measurement tools 200, 200' in accordance with the invention may also include angled standoff sensors configured for use in pitch catch mode. In the exemplary embodiments shown, measurement tools 200, 200' include at least one normally mounted transmitter element 220 and a plurality of angled receiver elements 230, 240. The transmitter 220 is typically configured to both transmit and receive ultrasonic energy in conventional pulse echo mode. Element 220 is also typically normally mounted in the tool body, although the invention is not limited in this regard. Receiver elements 230, 240 are typically angled in the same sense as standoff sensor 120 shown on FIG. 4 (such that the sensor axis is oriented at a non-zero angle with respect to the tool radius). In use, transmitter 220 transmits ultrasonic energy 252 into the borehole annulus. The reflected waveform 254 may then be received at one or more of elements 220, 230, and 240.

In the exemplary embodiment 200 shown on FIG. 5A, the transmitter 220 and receiver 230, 240 elements are deployed asymmetrically (e.g., both receivers are deployed on a common (the same) circumferential side of the transmitter). In such a configuration, the receiver 230 mounted in closer proximity to the transmitter 220 is typically angled less (e.g., an angle in the range from about 5 to about 20 degrees) than the receiver 240 that is more distant from the transmitter 220 (e.g., which may be angled in the range from about 15 to about 30 degrees). As depicted in the exemplary embodiment shown on FIG. 5A, receiver elements 230, 240 are disposed to receive reflected waveform 254 when measurement tool 200 is eccentered in the borehole 40.

In the exemplary embodiment 200' shown on FIG. 5B, the transmitter 220 and receiver 230, 240 elements are deployed symmetrically (e.g., receivers 230 and 240 are deployed on opposite circumferential sides of the transmitter 220). In such a configuration, the receivers 230, 240 are typically mounted at substantially the same angle (e.g., in the range from about 5 to about 30 degrees). Symmetric embodiments such as that shown on FIG. 5B, tend to advantageously best eliminate blind spots irrespective of the degree of borehole eccentricity.

It will be appreciated that downhole tools 200 and 200' are not limited to embodiments including three transmitter and receiver elements. Alternative embodiments may include, for example, four, five, six, or even seven transmitter and/or receiver elements.

Figure 6:
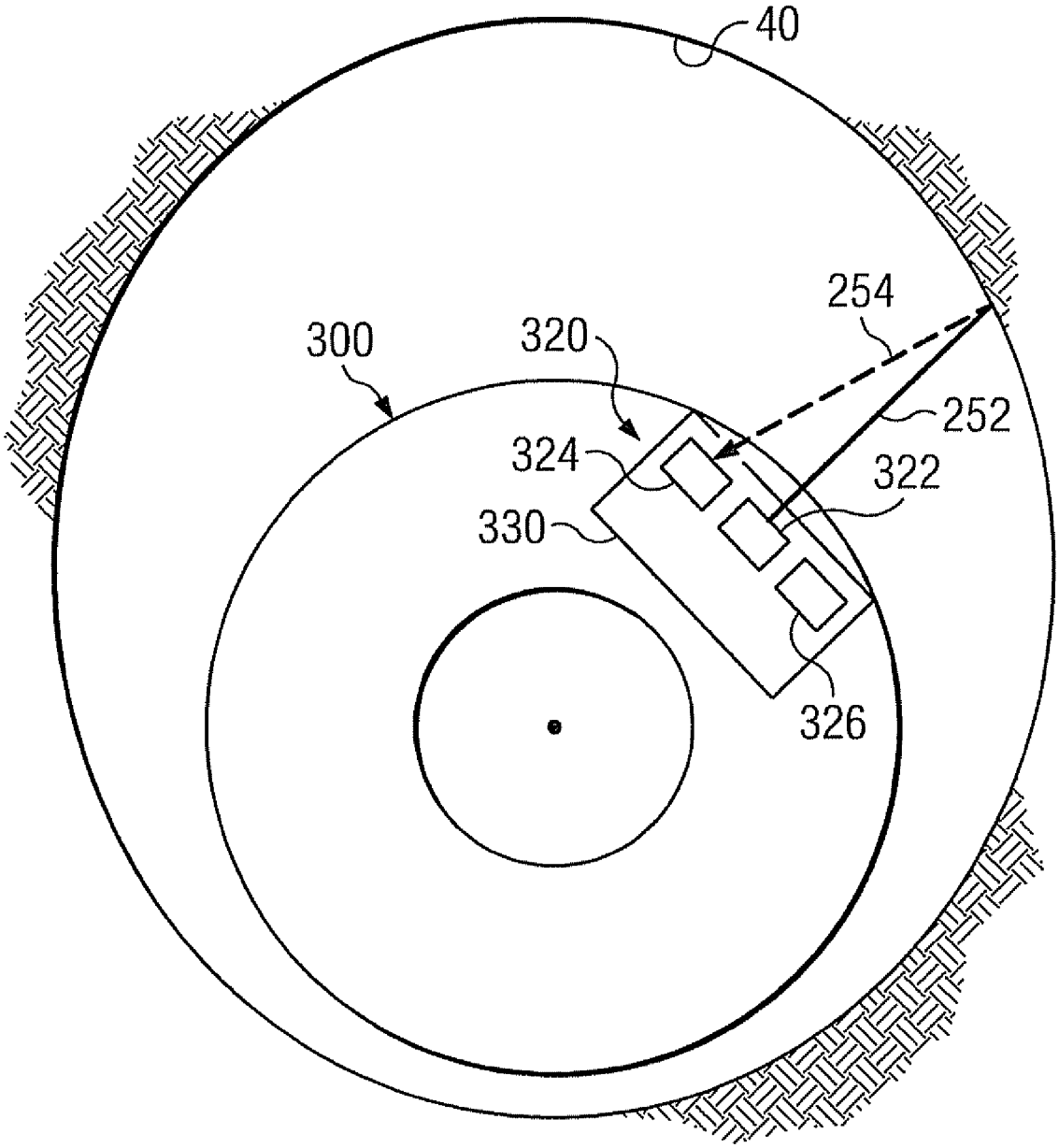
FIG. 6 depicts, in circular cross section, still another exemplary embodiment of the invention.

With reference now to FIG. 6, another exemplary embodiment 300 in accordance with the invention is depicted in circular cross section. In the exemplary embodiment shown, measurement tool 300 includes at least one ultrasonic sensor 320 deployed in a tool body 310. Sensor 320 includes at least three piezoelectric transducer elements 322, 324, 326 and operates in both pulse echo mode and pitch catch mode as described in more detail below. While the exemplary embodiment shown includes only a single sensor 320, it will be appreciated that measurement tool 300 may include additional ultrasonic sensors circumferentially or axially spaced from sensor 320 (for example two or three of ultrasonic sensors 320). Those of ordinary skill in the art will readily recognize that sensor 320 may further include conventional barrier layer(s), impedance matching layer(s), and/or attenuating backing layer(s), which are not shown in FIG. 6. The invention is not limited in these regards. It will also be appreciated that sensor 320 is not drawn to scale in FIG. 6.

Piezoelectric transducer elements 322, 324, and 326 are mounted in a sensor housing 330, which is further mounted in the tool body 310. Piezoelectric transducer element 322 is preferably normally mounted (as described above with respect to sensor 52 in FIG. 3). Transducer element 322 is further configured to both transmit and receive ultrasonic waves in a pulse echo mode. Transducer elements 324 and 326 are configured to receive ultrasonic waves from the borehole in pitch catch mode. In the exemplary embodiment shown, transducers 324 and 326 are deployed such that the transducer axes are parallel with the axis of element 322. The invention is not limited in this regard, however, as transducer elements 324 and 326 may also be angled relative to transducer element 322, for example, depending on expected operating conditions such as standoff values, borehole shape, and tool position in the borehole.

It will be appreciated that the invention is not limited to sensor embodiments having three transducer (transmitter and receiver) elements. Additional transducer elements may be utilized. For example, alternative sensor embodiments may include four, five, six, and even seven transducer elements. The invention is not limited in this regard, so long as the sensor includes at least three transducer elements. The invention is also not limited to embodiments having a central transducer element (e.g., element 322) and outer receiver elements (e.g., elements 324 and 326). Nor is the invention limited to embodiments in which only a single element transmits ultrasonic energy.

With continued reference to FIG. 6, one of the receivers (e.g., transducer element 324 in the exemplary embodiment shown on FIG. 6) typically receive a stronger signal than the other receiver (transducer element 326 in the exemplary embodiment shown) when the measurement tool 300 is eccentered in a borehole 40. It will be appreciated that when the measurement tool 300 is eccentered in the opposite direction that the other receiver (transducer element 326) tends to receive the stronger signal. When the measurement tool 300 is approximately centered in the borehole 40, the angle of incidence of the transmitted ultrasonic wave is nearly normal to the borehole wall 40 such that transducer element 322 tends to receive the strongest signal, while receivers 324 and 326 tend to receive relatively weaker signals.

Measurement tool 300 further includes a controller configured to calculate a standoff distance from the reflected waveforms received at transducer elements 322, 324, and 326. The controller may be further configured to estimate tool eccentricity in the borehole from the reflected waveforms received at transducer elements 322, 324, and 326. When the tool is centered in the borehole, the reflected ultrasonic energy tends to be approximately symmetric about the transducer element 322 such that elements 324 and 326 received approximately the same ultrasonic energy. When the tool is eccentered in the borehole, the reflected ultrasonic energy is asymmetric about transducer element 322 such that one of the elements 324 and 326 receives more energy than the other. In such a scenario, the degree of eccentricity may be estimated based on the difference (or the normalized difference or the ratio) of the ultrasonic energy received at elements 324 and 326. In general, an increasing difference or ratio (indicating a more asymmetric reflected signal) indicates a greater eccentricity. By combining such measurements with a conventional tool face measurement, the direction of the eccentricity may also be estimated.

Although the present invention and its advantages have been described in detail, it should be understood that various changes, substitutions and alternations can be made herein without departing from the spirit and scope of the invention as defined by the appended claims.

We claim:

1. A downhole logging while drilling tool comprising:

a substantially cylindrical tool body configured to be connected with a drill string, the tool body having a longitudinal axis;

at least first, second, and third ultrasonic sensors deployed in the tool body, at least the first of the ultrasonic sensors being configured to (i) transmit ultrasonic energy into a borehole and (ii) receive reflected ultrasonic energy from a borehole wall, at least a second and a third of the ultrasonic sensors being configured and disposed to receive the reflected ultrasonic energy transmitted by the first ultrasonic sensor; and a controller including instructions for estimating an eccentricity of the logging while drilling tool in a borehole from a difference or a ratio between the reflected ultrasonic energy received at the second transducer element and the reflected ultrasonic energy received at the third transducer element.

2. The logging while drilling tool of claim 1, wherein the second and the third ultrasonic sensors are deployed on a common circumferential side of the first ultrasonic sensor.

3. The logging while drilling tool of claim 1, wherein the second and the third ultrasonic sensors are deployed on opposing circumferential sides of the first ultrasonic sensor.

4. The logging while drilling tool of claim 1, wherein the first, the second, and the third ultrasonic sensors have corresponding first, second, and third sensor axes, the second and the third sensor axes being oriented at a non-zero angle relative to the first sensor axis, the second and the third sensor axes further being oriented at a non-zero angle relative to a radial direction in the tool body.

5. The logging while drilling tool of claim 1, wherein the first, the second, and the third ultrasonic sensors have corresponding first, second, and third sensor axes, the first sensor axis intersecting the longitudinal axis of the tool body, the second and third sensor axes being substantially parallel with the first sensor axis.

6. The logging while drilling tool of claim 1, wherein the controller includes instructions for determining a single standoff distance from the reflected ultrasonic energy received at the first, the second, and the third ultrasonic sensors.

7. A downhole logging while drilling tool comprising:

a substantially cylindrical tool body configured to be connected with a drill string, the tool body having a longitudinal axis;

an ultrasonic standoff sensor deployed in the tool body, the sensor including at least three circumferentially spaced piezoelectric transducer elements deployed in a common standoff sensor housing, at least a first of the transducer elements being configured to (i) transmit ultrasonic energy into a borehole and (ii) receive reflected ultrasonic energy from a borehole wall, at least a second and a third of the transducer elements being configured to receive the reflected ultrasonic energy transmitted by the first transducer element; and a controller including instructions for estimating an eccentricity of the logging while drilling tool in a borehole from a difference or a ratio between the reflected ultrasonic energy received at the second transducer element and the reflected ultrasonic energy received at the third transducer element.

8. The logging while drilling tool of claim 7, wherein the second and the third transducer elements are deployed on a common circumferential side of the first transducer element.

9. The logging while drilling tool of claim 7, wherein the second and the third transducer elements are deployed on opposing circumferential sides of the first transducer element.

10. The logging while drilling tool of claim 7, wherein the first, the second, and the third transducer elements have corresponding first, second, and third sensor axes, the second and the third sensor axes being oriented at a non-zero angle relative to the first sensor axis, the second and the third sensor axes further being oriented at a non-zero angle relative to a radial direction in the tool body.

11. The logging while drilling tool of claim 7, wherein the first, the second, and the third transducer elements have corresponding first, second, and third sensor axes, the first sensor axis intersecting the longitudinal axis of the tool body, the second and third sensor axes being substantially parallel with the first sensor axis.

12. The logging while drilling tool of claim 7, wherein the controller includes instructions for determining a single standoff distance from the reflected ultrasonic energy received at the first, the second, and the third ultrasonic sensors.

13. A method for estimating downhole an eccentricity of a logging while drilling tool during drilling, the method comprising:

(a) deploying a downhole tool in a subterranean borehole, the tool including an ultrasonic standoff sensor having at least three circumferentially spaced piezoelectric transducer elements, at least a first of the transducer elements being configured to (i) transmit ultrasonic energy into a borehole and (ii) receive reflected ultrasonic energy, at least a second and a third of the transducer elements being configured to receive the reflected ultrasonic energy originally transmitted by the first transducer element;

(b) causing the first transducer element to transmit ultrasonic energy into the borehole;

(c) causing at least the second and the third transducer elements to receive the ultrasonic energy transmitted in (b); and (d) processing a difference or a ratio between the ultrasonic energy received at the second transducer element and the ultrasonic energy received at the third transducer element received in (c) to estimate a degree of eccentricity of the downhole tool in the borehole.

14. The method of claim 13, wherein an increasing difference or ratio indicates an increasing eccentricity.

* * * * *